US005445079A

United States Patent [19]

Boual

[11] Patent Number: 5,445,079

[45] Date of Patent: Aug. 29, 1995

[54] ARMOR-PIERCING FRAGMENTATION PROJECTILE

[75] Inventor: Roland Boual, Saint-Germain-du-Puy, France

[73] Assignee: Giat Industries, Versailles, France

[21] Appl. No.: 221,240

[22] Filed: Mar. 31, 1994

Related U.S. Application Data

[62] Division of Ser. No. 946,471, Nov. 10, 1992, Pat. No. 5,325,787.

[51] Int. Cl.[6] ..... F42B 12/56

[52] U.S. Cl. ..... 102/506; 102/517

[58] Field of Search ..... 102/389, 501, 506–510, 102/514–519, 529

[56] References Cited

U.S. PATENT DOCUMENTS

| | | | |
|---|---|---|---|
| 631,703 | 8/1899 | Dunn | 102/496 |
| 1,276,082 | 8/1918 | Kuhn | 102/497 |
| 1,709,414 | 4/1929 | Stendebach | 102/509 |
| 3,242,865 | 3/1966 | Jungermann et al. | 102/529 |
| 4,353,305 | 10/1982 | Moreau et al. | 102/519 |
| 4,643,099 | 2/1987 | Luther et al. | 102/517 |
| 4,753,172 | 6/1988 | Katzmann et al. | 102/517 |
| 4,770,102 | 9/1988 | Bisping et al. | 102/521 |
| 4,774,889 | 10/1988 | Wallow et al. | 102/517 |
| 4,854,242 | 8/1989 | Katzmann | 102/506 |

FOREIGN PATENT DOCUMENTS

| | | | |
|---|---|---|---|
| 146745 | 7/1985 | European Pat. Off. | 102/517 |
| 3802002 | 8/1989 | Germany . | |
| 305149 | 4/1955 | Switzerland . | |
| 670882 | 7/1989 | Switzerland | 102/518 |
| 21378 | of 1896 | United Kingdom . | |
| 2011041 | 7/1979 | United Kingdom . | |
| 2113810 | 8/1983 | United Kingdom . | |

*Primary Examiner*—Harold J. Tudor
*Attorney, Agent, or Firm*—Oliff & Berridge

[57] ABSTRACT

An armor-piercing fragmentation ammunition projectile includes a body made of a dense material, a head also made of a dense material, and an arrangement for fragmenting the body on impact. It is characterized in that the arrangement includes a blind hole delimited by the body and occupied by a mass of compression material subjecting the body to a fragmentation pre-stress. Application to sub-caliber projectiles.

12 Claims, 1 Drawing Sheet

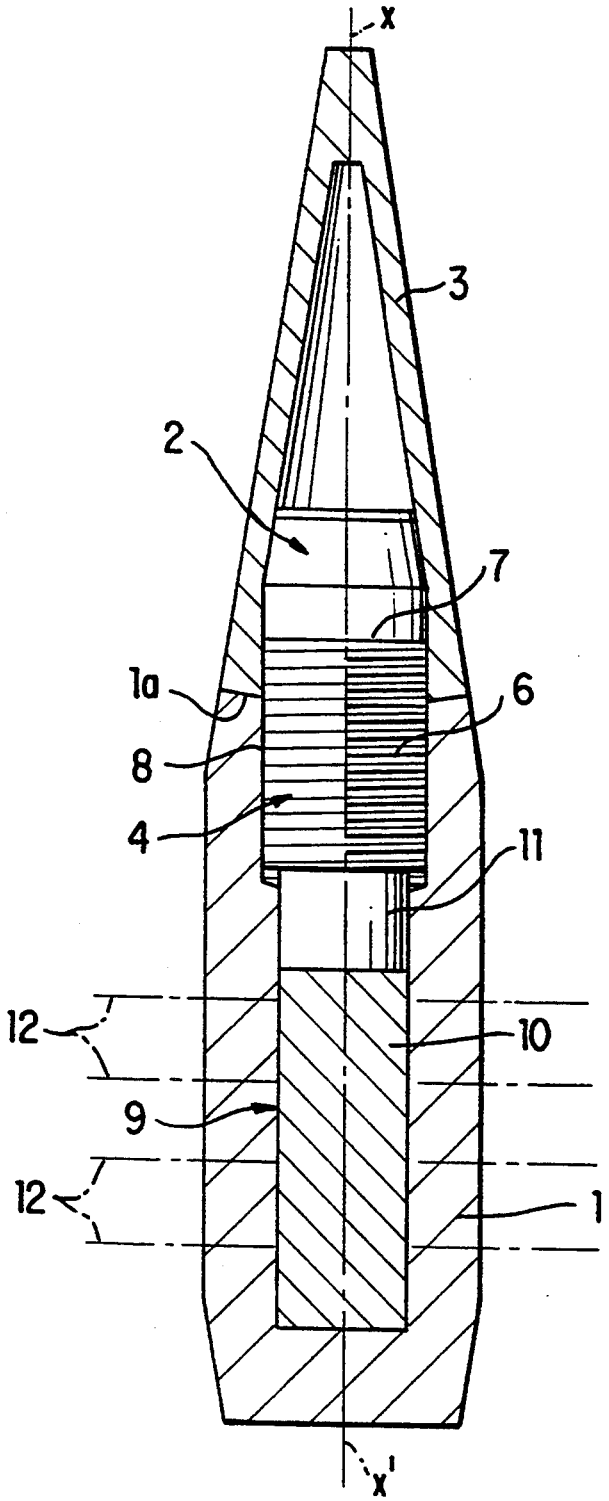
X
3
2
7
1a
6
8
4
11
12
10
9
12
1
X'

ARMOR-PIERCING FRAGMENTATION PROJECTILE

This is a division of application Ser. No. 07/946,471, filed Nov. 10, 1992, now U.S. Pat. No. 5,325,787.

BACKGROUND OF THE INVENTION

This invention concerns the technical field of projectiles used to destroy, at a distance, a target of some description, more generally one of an armored nature.

This invention concerns projectiles of the armor-piercing type.

Destruction of a target at a great distance, and more particularly of an armored target, requires high firing accuracy as well as considerable terminal effectiveness.

High firing accuracy can be obtained utilizing projectiles, for example of the small-caliber, armor-piercing type, which because of their design, develop a high level of impact energy while offering remarkable firing accuracy during their external ballistic trajectory.

Terminal destructive effectiveness can be obtained with the use of an explosive projectile, in other words one containing inside it a charge causing the projectile to explode at the moment of impact.

Utilization of a combination of these two characteristics might be envisaged as a way of creating a shell or projectile capable of meeting the criterion of a capacity for accurate destruction, of an armored target at great distance.

However, creation of a projectile combining these two characteristics is relatively costly, and involves handling, an explosive charge during manufacture which must be strictly monitored to prevent untimely explosions.

The presence of such a charge also entails the same problems in terms of storing, handling, and assembling projectiles in or on facilities responsible for firing them.

SUMMARY OF THE INVENTION

An object of the invention is to meet the above objective by proposing a new projectile specifically designed to possess the firing accuracy characteristics of an armor-piercing projectile and the characteristics of considerable terminal effectiveness, without necessarily entailing the presence of an onboard explosive charge.

To achieve the above objectives, the projectile according to the invention is characterized by possessing a structure for fragmenting the body upon impact, includes a blind bore delimited by the body and occupied by a mass of compressed material subjecting the body to a fragmentation prestress.

BRIEF DESCRIPTION OF THE DRAWINGS

Various other characteristics will become evident from the description given below with reference to the attached drawing which shows, as a nonlimiting example, an embodiment of the object of the invention.

The single figure is a sectioned front view of an embodiment of the present invention.

DETAILED DESCRIPTION OF PREFERRED EMBODIMENTS

The projectile as depicted comprises a body 1 made of a dense material, such as for example sintered tungsten, depleted uranium, or tungsten carbide.

Body 1 is designed in the usual manner in terms of length and caliber, and has a longitudinal axis, or axis of revolution, x—x'.

Body 1 is associated with an armor-piercing head 2, also made of a dense material such as for example a treated steel. Head 2 is surrounded and covered by a ballistic shroud made of a malleable material having good air penetration characteristics by virtue of its shape and nature, made for example of light alloy or copper alloy. Ballistic shroud 3 can be attached onto body 1 by crimping or shrink-fitting, so as then to have a cut-off anterior portion. Shroud 3 may also be attached directly onto head 2 when the latter is coupled, by any appropriate means, to body 1, as is the case with the object depicted.

Body 1 and head 2 are attached by a mechanical attachment 4 which comprises, in a preferred but nonlimiting embodiment, a threaded terminal part 6 extending from rear face 7 of head 2, having a diameter which can be equal to or less than that of head 2.

The mechanical attachment also comprises a tapped thread 8 which is arranged starting from anterior part 1*a* of body 1, at the mouth of a cylindrical bore 9. Cylindrical bore 9 is to med along axis x-x' within body 1. Tapped thread 8 is designed to be complementary to screw thread 6, to allow attachment by traditional threading, either left- or right-handed.

The invention provides for body 1 to be subjected to a fragmentation prestress which is applied by utilizing the presence of bore 9 which is intended to be occupied by a compression/prestress mass 10.

Various fragmentation prestress means can be adopted on the basis of mass 10.

A first means consists in utilizing 2 compressible plastic material to constitute the mass, in other words one having the characteristic of remaining compressed after compression. Such a material can consist of a metal powder, a mass of chips, a powdered pyrotechnic composition, etc. Such a material is compressed in bore 9 so as to occupy, if not all of it, at least the majority. This compression is applied so as to generate a prestress on body 1, either solely radial or radial and axial, selected in any case so that the mechanical strength of the body is preserved. The total prestress must therefore be located in a range such that the maximum value preserves the initial integrity of body 1, but the minimum value is sufficient to improve the fragmentation of the body upon impact.

The total prestress applied to the body is preferably between:

$$0.1 \times E0.2\% \text{ and } 0.4 \times E0.2\%$$

where E0.2% defines the proof stress of the material of body 1, i.e., the stress value producing a 0.2% permanent deformation of said material.

As an example, a material 10 can be made of powdered tungsten, compressed at between 600 and 800 MPa into a body 1 made of sintered tungsten.

Another approach can be to subject material 10, once compressed in this manner, to an axial prestress on the order of:

$$\frac{Rm}{3.5}$$

where Rm represents the rupture strength of the material of body 1.

In this embodiment, compression of material 10 is performed, after which head 2 is attached to close off bore 9 to ensure, preferably directly by means of an external posterior extension II or by means of an independent piston, contact with compressed material 10.

In a second embodiment an elastically compressible material 10, such as an elastomer is used. In this case, prestress is produced by the combination of a radial prestress and an axial prestress, the radial prestress being a consequence of the radial deformation of the rubber subjected to an axial force.

The total prestress must again be within the range defined previously. Such a prestress is then advantageously applied by means of head 2 of the screwed-on type.

In yet another embodiment an incompressible material 10, such as balls, pebbles, stones, or cylinders is used. The fragmentation prestress is then exclusively of the axial type, and is applied to body 1 when head 2 is installed by being screwed on. Such an axial prestress is preferably between:

$$\frac{Rm}{3.5} \text{ and } \frac{Rm}{3}$$

When it strikes the target, the projectile according to the invention undergoes a release of the previous stress or stresses imposed upon it by manufacture. The shock wave promotes release of these stresses, which increases the fragmentation velocity and capacity of body 1; this results in a greater number of splinters and a larger burst of splinters than would be the case if, when previously assembled, it had been devoid of initial stresses.

To improve fragmentation, body 1 can possess zones of lesser strength, either axial or preferably transverse, as depicted by dot-dashed lines and labeled with the number 12.

Improved fragmentation can also be obtained by utilizing, in addition to the axial and/or radial prestress, a pyrotechnic charge 10, explosion of which is caused by impact.

The invention is not limited to the example described and depicted, since a variety of modifications can be made to it without departing from the scope of the invention which is defined in the following claims.

One advantageous application of the invention is to small-caliber projectiles.

I claim:

1. An armor-piercing, explosive free fragmentation projectile comprising a one-piece body made of a first material, a head made of a second material, and means for causing multiple fragmentation of the body upon impact, said means comprising a blind bore delimited by the body and occupied by a mass of compressible material subjecting said body to a fragmentation prestress by the compressible material being compressed into said blind bore, wherein fragmentation prestress is between $0.1 \times E0.2\%$ and $0.4 \times E0.2\%$, said head being secured to the body and contacting said compressible material, said blind bore extending within said body substantially along its entire length, wherein said first material is selected from the group consisting of sintered tungsten, depleted uranium, and tungsten carbide.

2. The projectile according to claim 1, wherein the mass of compressible material subjects said body to a fragmentation prestress in at least an axial direction.

3. The projective according to claim 2, wherein the mass comprises compressible materials of a plastic nature, previously compressed in the bore and maintained therein by the head being secured to the body and covered by a ballistic shroud.

4. The projectile according to claim 2, wherein the mass comprises compressible materials of an elastic nature, compressed in the bore by the head being secured to the body and covered by a ballistic shroud.

5. The projectile according to claim 2, wherein the body comprises zones of lesser resistance to facilitate fragmentation of the body upon impact.

6. The projectile according to claim 1, wherein the mass comprises compressible materials of a plastic nature, previously compressed in the bore and maintained therein by the head being secured to the body and covered by a ballistic shroud.

7. The projectile according to claim 1, wherein the mass comprises compressible materials of an elastic nature, compressed in the bore by the head being secured to the body and covered by a ballistic shroud.

8. The projectile according to claim 7, wherein the head is mounted in a threaded manner on the body to penetrate into the bore with a posterior extension.

9. The projectile according to claim 1, wherein the body comprises zones of lesser resistance to facilitate fragmentation of the body upon impact.

10. The projectile according to claim 1, wherein said head comprises a posterior extension penetrating into the blind bore when the head is secured to the body.

11. The projectile according to claim 1, further comprising a ballistic shroud covering said head.

12. The projectile according to claim 1, wherein said fragmentation prestress is increasable by the head being threaded into said body.

* * * * *